United States Patent [19]

Long

[11] Patent Number: 4,740,391

[45] Date of Patent: Apr. 26, 1988

[54] PATTERN FORMING SATURATOR AND METHOD

[75] Inventor: Eliot R. Long, Arlington Heights, Ill.

[73] Assignee: Miply Equipment, Inc., South Bend, Ind.

[21] Appl. No.: 1,887

[22] Filed: Jan. 9, 1987

Related U.S. Application Data

[63] Continuation-in-part of Ser. No. 883,550, Jul. 9, 1986.

[51] Int. Cl.[4] ..... B05D 5/00; B05D 1/18, B05C 3/18

[52] U.S. Cl. ..... 427/286; 118/410; 118/419; 427/288; 427/434.3; 427/434.5; 427/439

[58] Field of Search ..... 118/429, 419, 426, 410; 427/286, 439, 434.2, 434.5, 434.3, 288; 68/158

[56] References Cited

U.S. PATENT DOCUMENTS

| | | | |
|---|---|---|---|
| 1,546,834 | 7/1925 | Hanington | 101/129 |
| 2,056,274 | 10/1936 | Holdsworth | 264/167 |
| 2,238,013 | 4/1941 | Collings et al. | 427/358 |
| 2,711,032 | 6/1955 | Penley | 34/122 |
| 2,904,448 | 9/1959 | Sorg | 427/208.2 |
| 3,088,859 | 5/1963 | Smith | 156/26 |
| 3,436,245 | 4/1969 | Grundman | 428/89 |
| 3,772,054 | 11/1973 | Anselrode | 427/282 |
| 3,798,120 | 3/1974 | Enloe et al. | 162/112 |
| 4,280,343 | 7/1981 | Fleissner | 68/158 |
| 4,588,616 | 5/1986 | Menser | 427/430.1 |

FOREIGN PATENT DOCUMENTS 0173519 5/1986 European Pat. Off. .

*Primary Examiner*—Evan K. Lawrence
*Attorney, Agent, or Firm*—Willian Brinks Olds Hofer Gilson & Lione Ltd.

[57] ABSTRACT

A saturator of the type which includes a chamber situated between a chamber defining element and a mandrel, in which a web is moved through the chamber to impregnate the web with a saturant contained in the chamber, includes a chamber defining element which defines an array of grooves. The grooves are separated by raised surfaces. The raised surfaces cooperate with the mandrel to pressurize the saturant in a high pressure zone which causes a relatively large amount of saturant to enter the web. The grooves define respective low pressure zones, which cause a reduced amount of saturant or no saturant to impregnate the web. A desired pattern of impregnation of the web can be obtained by properly positioning the grooves with respect to the raised surfaces on the chamber defining element.

27 Claims, 8 Drawing Sheets

PATTERN FORMING SATURATOR AND METHOD

CROSS REFERENCE TO RELATED APPLICATION

This application is a continuation-in-part of co-pending application Ser. No. 883,550, filed July 9, 1986.

BACKGROUND OF THE INVENTION

The present invention relates to saturators for impregnating a substrate with a saturant, and in particular to an improved saturator and saturating method for impregnating selected portions of a substrate with increased amounts of a saturant.

Saturators have been used for some time to impregnate substrates such as webs of paper with varying amounts of saturants. By properly selecting the amount and type of saturant to provide the desired characteristics to the substrate, saturators can be used to enhance the physical characteristics, and therefore the value, of the substrate.

For example, one valuable saturant is sodium silicate. When high levels of sodium silicate are added to a paper web, the paper can be made fire resistant and can be given much improved structural strength. However, such highly impregnated paper can be difficult to fold or crease in conventional paper processing machines. It therefore would be advantageous to impregnate a paper web with increased amounts of sodium silicate at selected portions of the web. For example, if a paper web were to be used to form a box in which stacking strength were an important consideration, it would often be advantageous to apply increased amounts of sodium silicate to the sidewalls of the box as compared with the top and bottom panels, which must be folded in use.

As another example, containers such as beer cases are subjected to unusual wear patterns. The tops and bottoms of the cans within the case act as cookie cutters during transportation and can severely damage either the printing on or the actual structure of the top and bottom panels of the case. If sodium silicate were applied to the top and bottom panels, this cookie cutter effect could be resisted effectively. In this example, however, there is no need to apply large amounts of sodium silicate to the sidewalls, and it would reduce the cost of materials if the saturant could be concentrated at the top and bottom panels and not the sidewalls of the case.

In spite of the important advantages that selective saturation would provide in the examples described above, the applicant is unaware of any commercially available saturator that performs this function. The saturator described in Menser U.S. Pat. No. 4,588,616 is an extremely effective device which can be used to saturate substrates with a range of saturants at both relatively low and extremely high add-on weights. Similarly, U.S. Pat. No. 2,711,032 describes another type of saturator used in the past. However, neither of these saturators is provided with means for selectively impregnating desired portions of the web with increased amounts of the saturant.

In the past, stencils have been used with a variety of surface applicators for liquids of various types. However, such stencils have not, to the knowledge of the applicant, been used with saturators. Instead, stencils have typically been used with applicators which apply liquid to the surface of a web without substantial impregnation. Examples of such applicators are spray devices (Smith U.S. Pat. No. 3,088,859); extruders (Sorg U.S. Pat. No. 2,904,448); roller applicators (Holdsworth U.S. Pat. No. 2,056,274); and spreaders (Hannington U.S. Pat. No. 1,546,834). Such applicators differ significantly from saturators in that they apply a liquid to the surface of the substrate without specific pressure to force the applied liquid into the interslices of the substrate and therefore do not provide deep impregnation as does a saturator.

SUMMARY OF THE INVENTION

The present invention is directed to an improved pattern-formed saturator and to a method for selectively saturating desired portions of a web. As used herein, the terms "saturator" and "saturate" are not meant to suggest that extremely high levels of saturant are forced into the web. To the contrary, a saturator can be used to introduce a low level of saturant into a web, at an add on weight of 1%, for example.

According to the apparatus of this invention, a saturator is provided of the type comprising means for defining a chamber which converges in depth from an entrance region to an exit region, means for supplying a saturant to the chamber, and means for passing a porous web through the chamber from the entrance region to the exit region. The chamber is shaped such that movement of the saturant through the chamber pressurizes the saturant in a pressurized zone which includes at least the exit region, thereby impregnating the web with the saturant. Means are provided in the chamber defining means for forming at least one reduced pressure zone in the exit region adjacent to the pressurized zone. This reduced pressure zone is characterized by a reduced saturant pressure as compared with the pressurized zone such that a greater amount of the saturant is forced into portions of the web aligned with the pressurized zone than with the reduced pressurized zone. In some embodiments the saturant may not contact the web in the reduced pressure zone or the saturant pressure may be so low in the reduced pressure zone as to prevent any substantial movement of saturant into the web. In other embodiments the reduced pressure zone can be arranged to force a desired, relatively lower level of saturant into the web as compared with the pressurized zone.

According to the method of this invention, a chamber is provided which includes an entrance region and an exit region and which converges from the entrance region to the exit region in a first, relatively high pressure zone. This chamber also defines a second, relatively low pressure zone situated alongside the high pressure zone. A saturant is introduced into the chamber and the web is passed through the chamber from the entrance region to the exit region such that the saturant is brought into contact with the web in both the high pressure zone and the low pressure zone. The chamber is shaped such that the movement of the saturant through the chamber generates higher pressures in the high pressure zone than in the low pressure zone, thereby impregnating portions of the web aligned with the high pressure zone with a greater amount of saturant than portions of the web aligned with the low pressure zone.

As described in detail below, the present invention provides important advantages in that it allows selected, patterned portions of a web to be impregnated with increased amounts of the saturant. By applying increased amounts of the saturant only where it is needed on the web, the cost of saturant is reduced, and the end product can actually be improved. For example, impregnation of the web can be reduced or avoided in regions where the web will be creased or folded, such that the saturant does not interfere with such subsequent processing operations. As another example, saturant can be substantially prevented from impregnating patterned portions of the web which will subsequently be printed in the event a saturant is used which in high concentrations detracts from the clarity or color trueness of the printing operation.

The invention itself, together with further objects and attendant advantages, will best be understood by reference to the following detailed description, taken in conjunction with the accompanying drawings.

Figure 1:
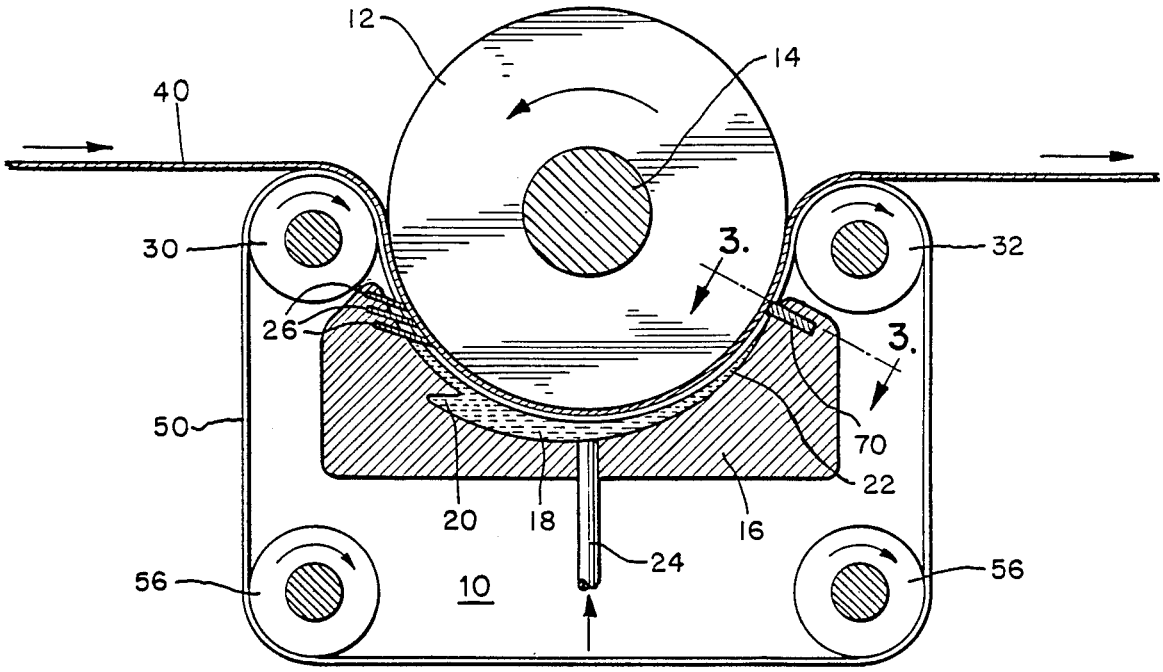
FIG. 1 is a cross-sectional view through a first pattern-forming saturator.

FIGS. *2a, 2b* and *2c* are partial plan views of alternative stencils suitable for use in the saturator of FIG. 1.

Figure 3:
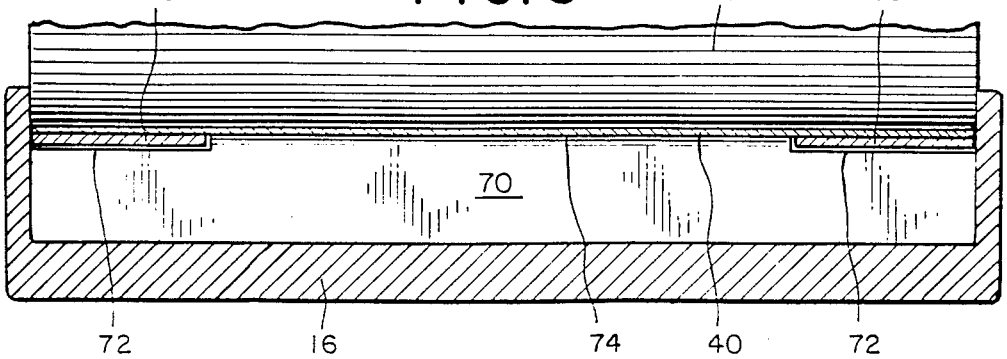

FIG. 3 is a sectional view taken along line 3—3 of FIG. 1.

Figure 4:
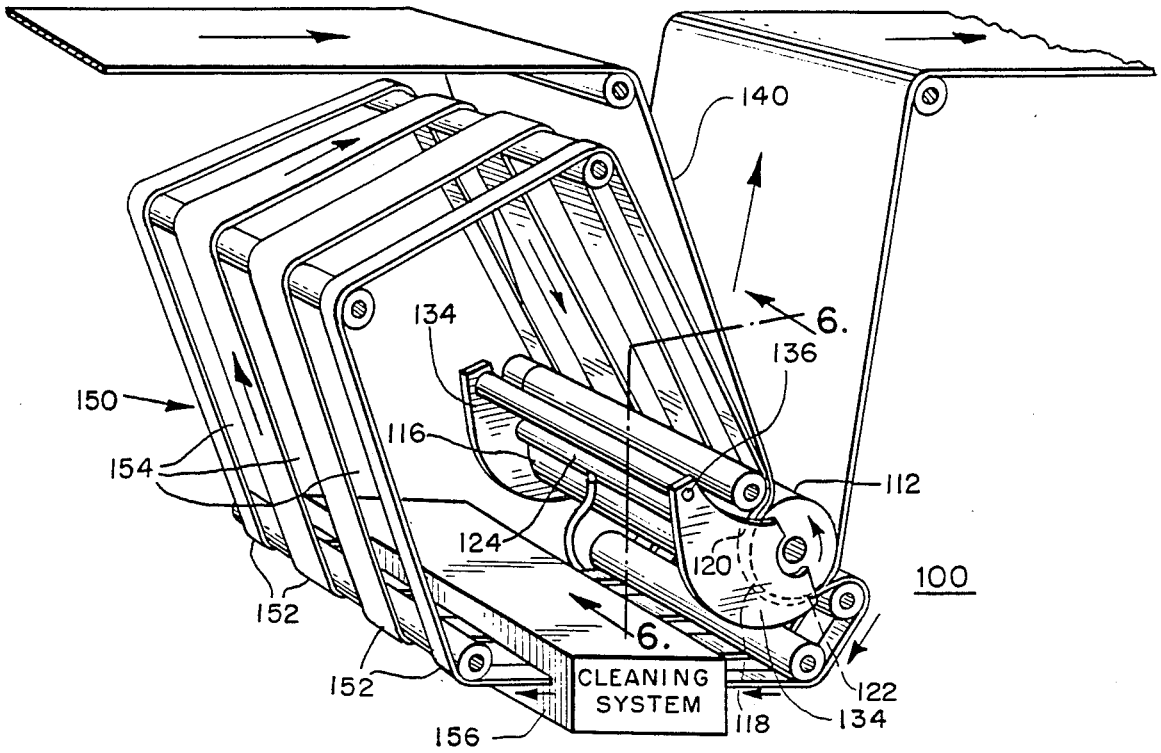

FIG. 4 is a perspective view of a second pattern-forming saturator.

Figure 5:
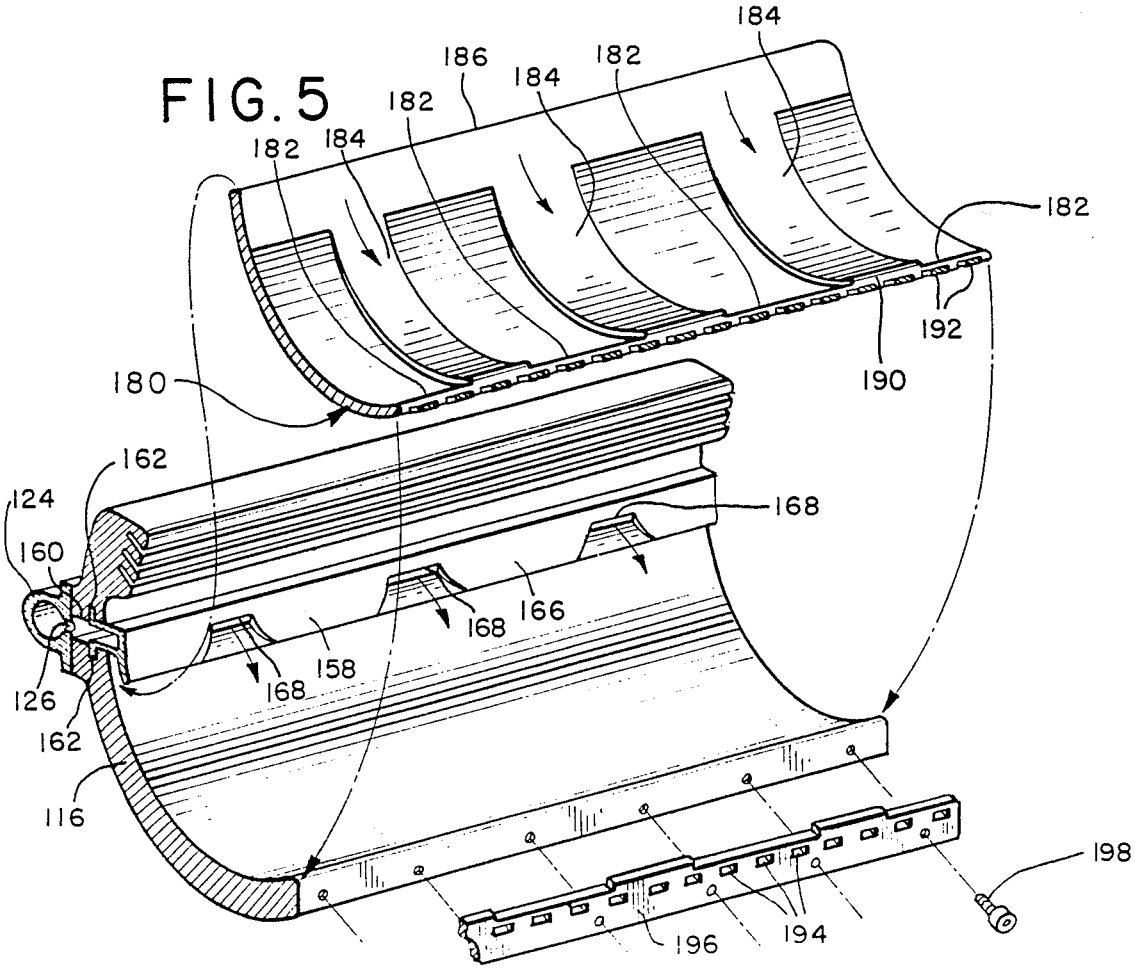

FIG. 5 is an exploded perspective view of components of the saturator of FIG. 4.

Figure 6:
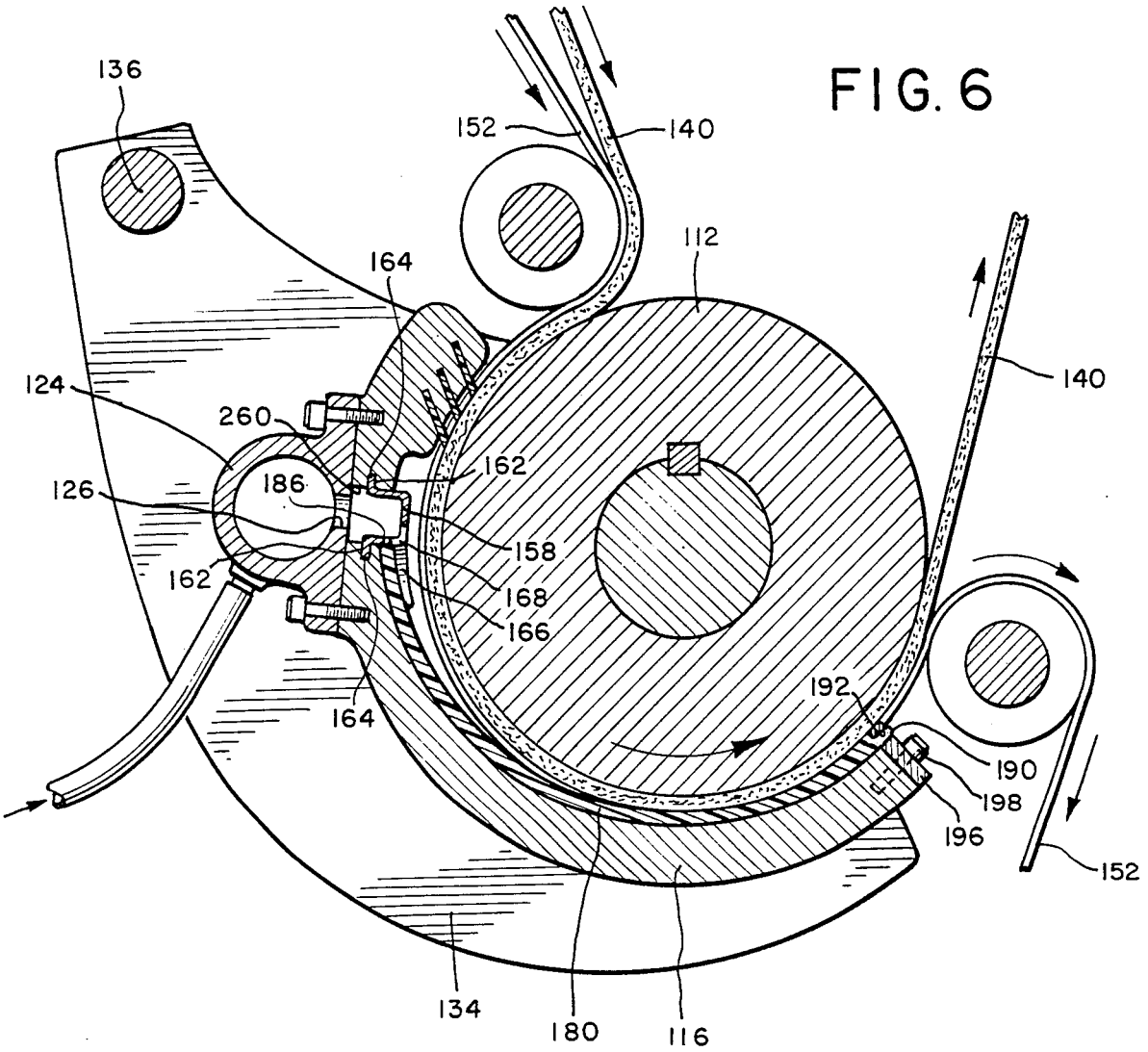

FIG. 6 is a sectional view taken along line 6—6 of FIG. 5.

Figure 7:
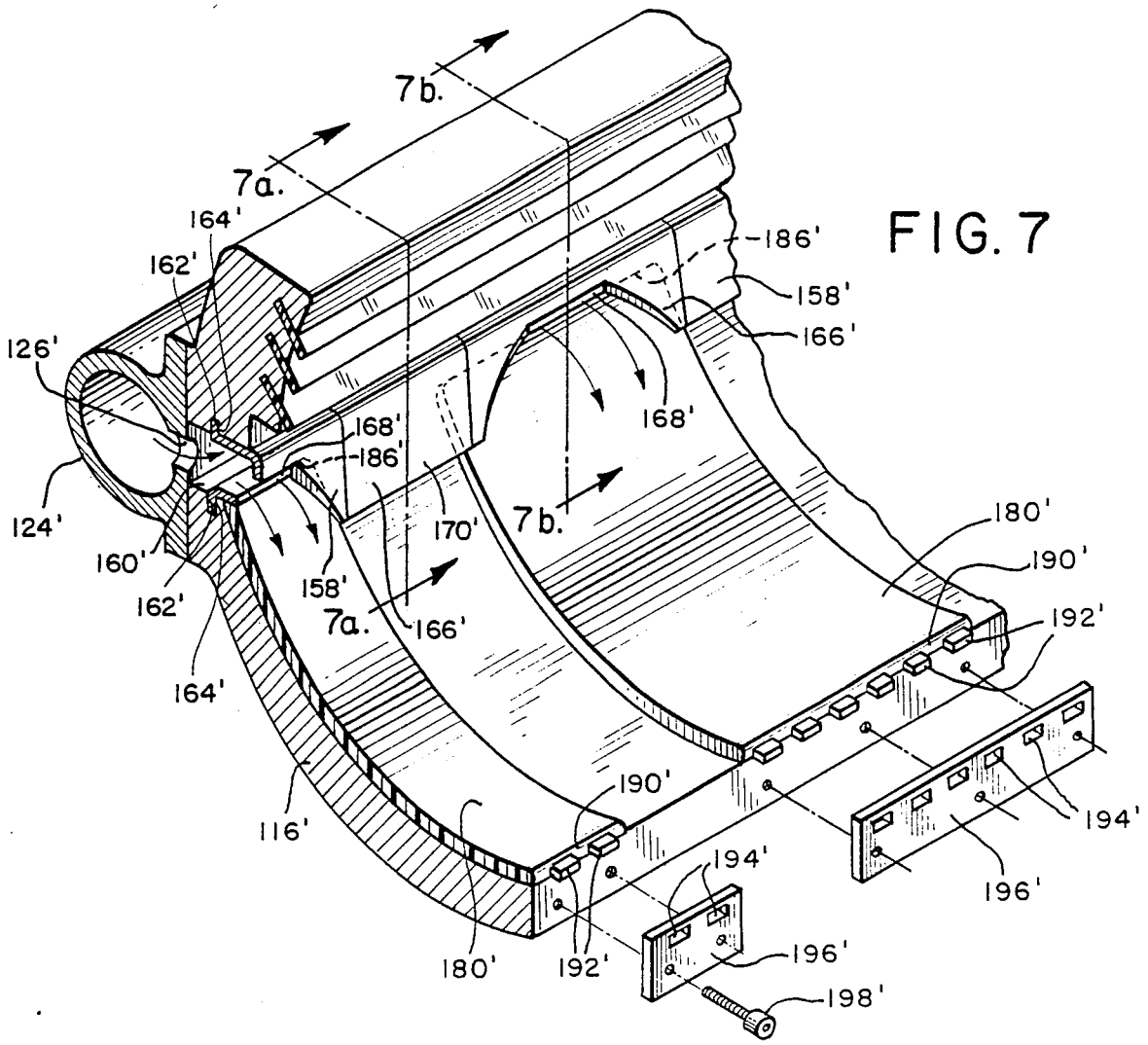

FIG. 7 is a fragmentary perspective view of portions of a variant of the saturator of FIG. 4.

FIG. *7a* is a sectional view taken along line *7a—7a* of FIG. 7.

FIG. *7b* is a sectional view taken along line *7b—7b* of FIG. 7.

Figure 8:
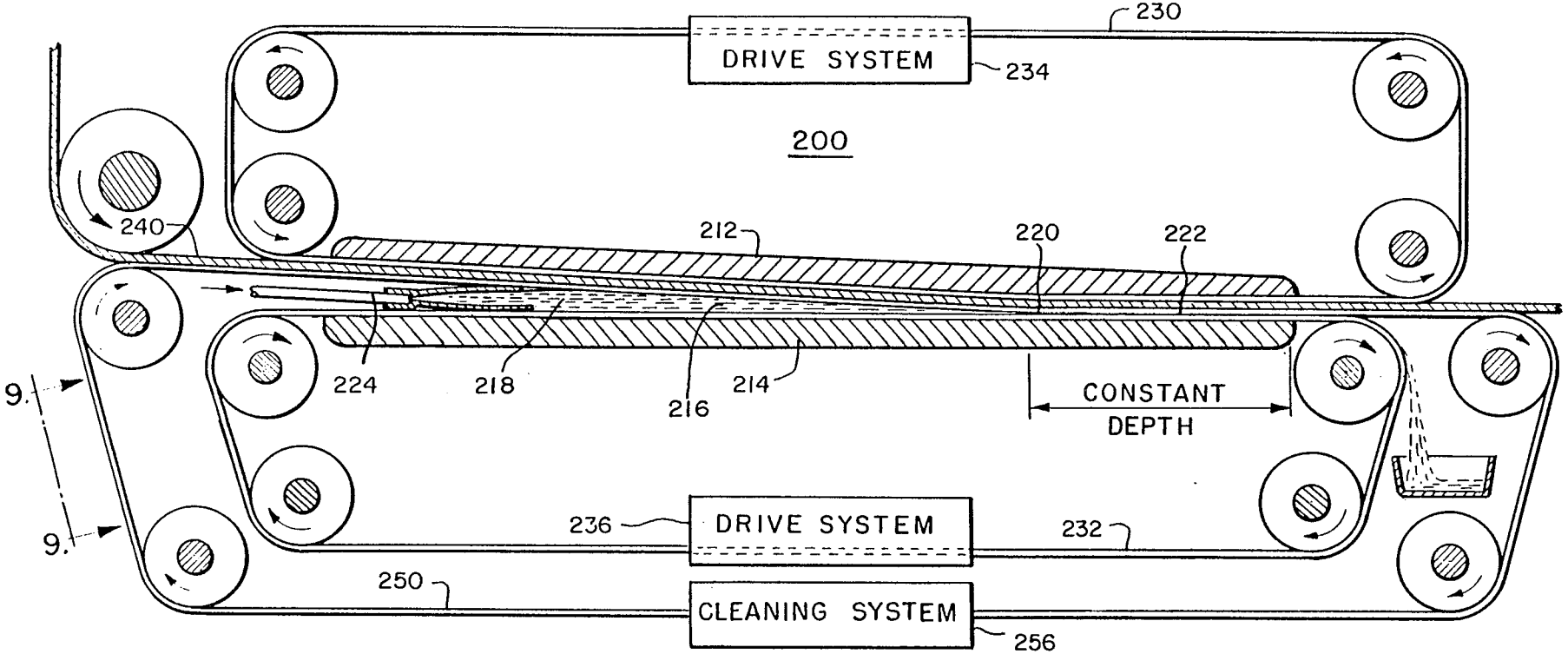

FIG. 8 is a cross-sectional view of a fourth pattern-forming saturator.

Figure 9:
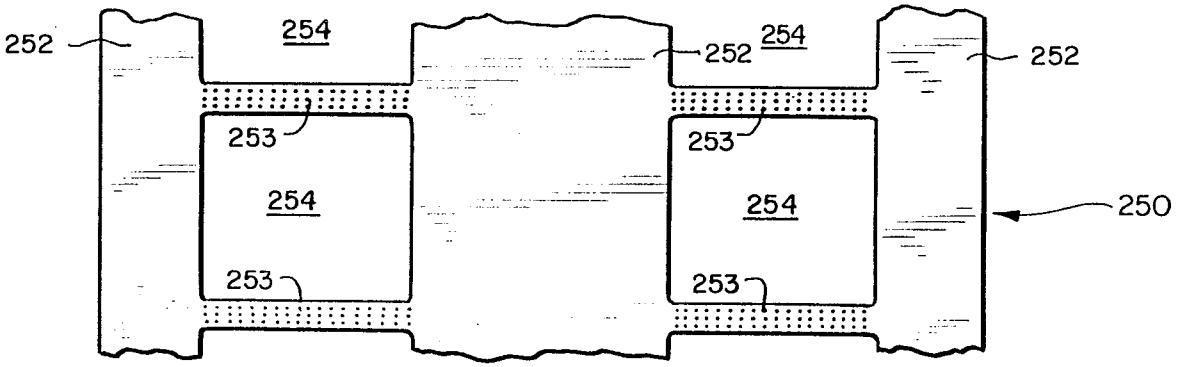

FIG. 9 is a fragmentary view taken along line 9—9 of FIG. 8.

Figure 10:
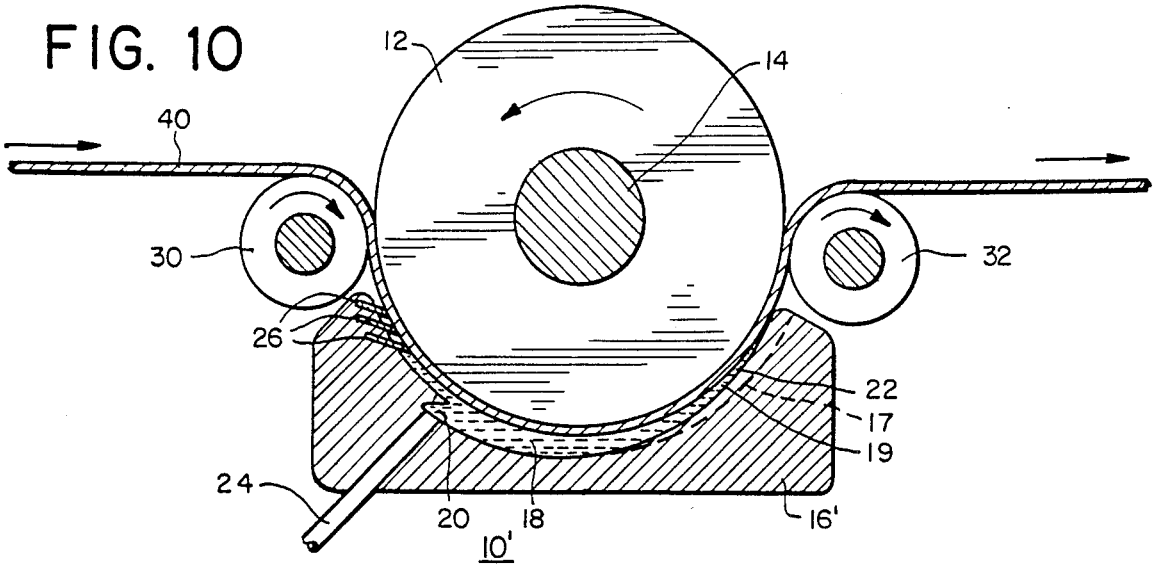

FIG. 10 is cross-sectional view through a fifth pattern-forming saturator which is similar in some respects to the saturator of FIG. 1.

Figure 11:
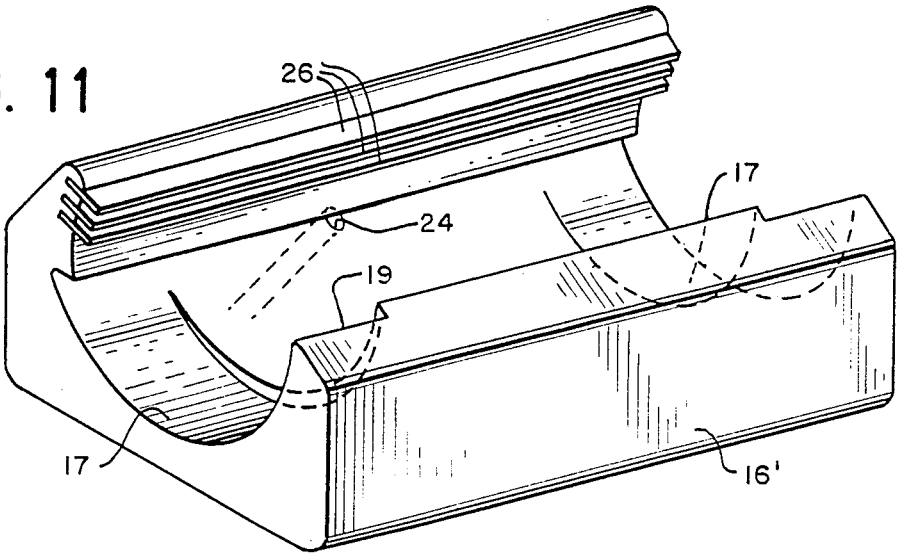

FIG. 11 is a perspective view of components of the saturator of FIG. 10.

Figure 12:
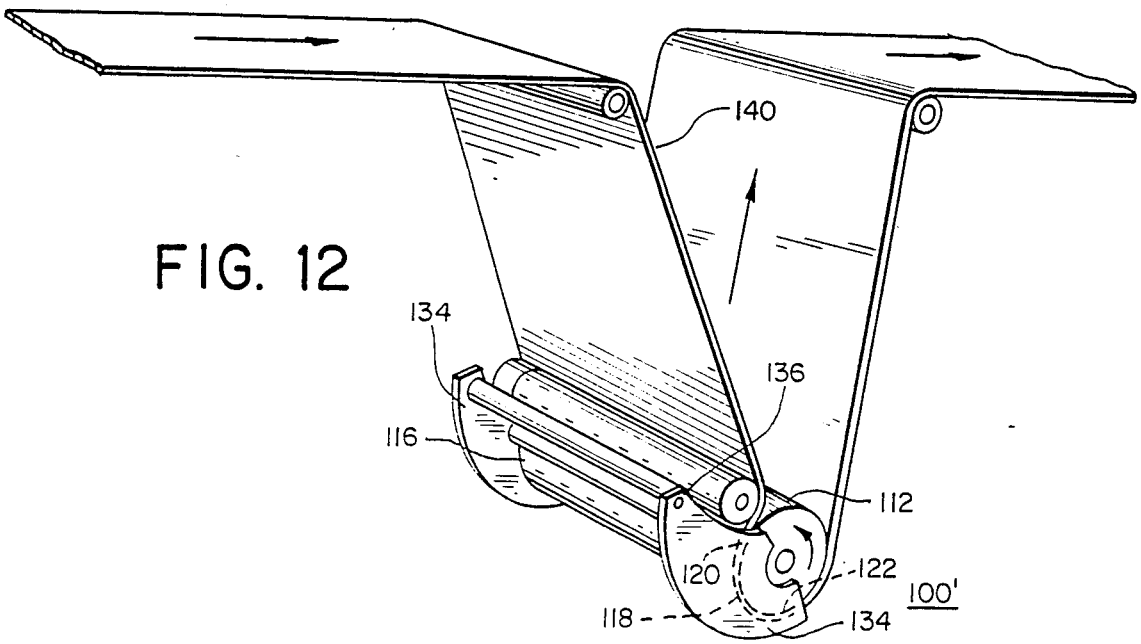

FIG. 12 is a perspective view of a sixth pattern-forming saturator which is similar in some respects to the saturator of FIG. 4.

Figure 13:
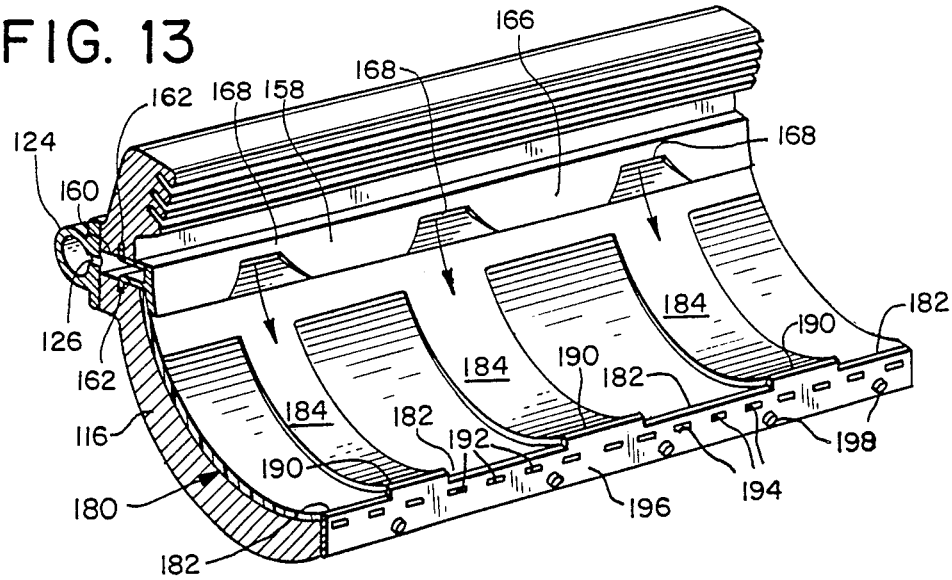

FIG. 13 is a perspective view of components of the saturator of FIG. 12.

Figure 14:
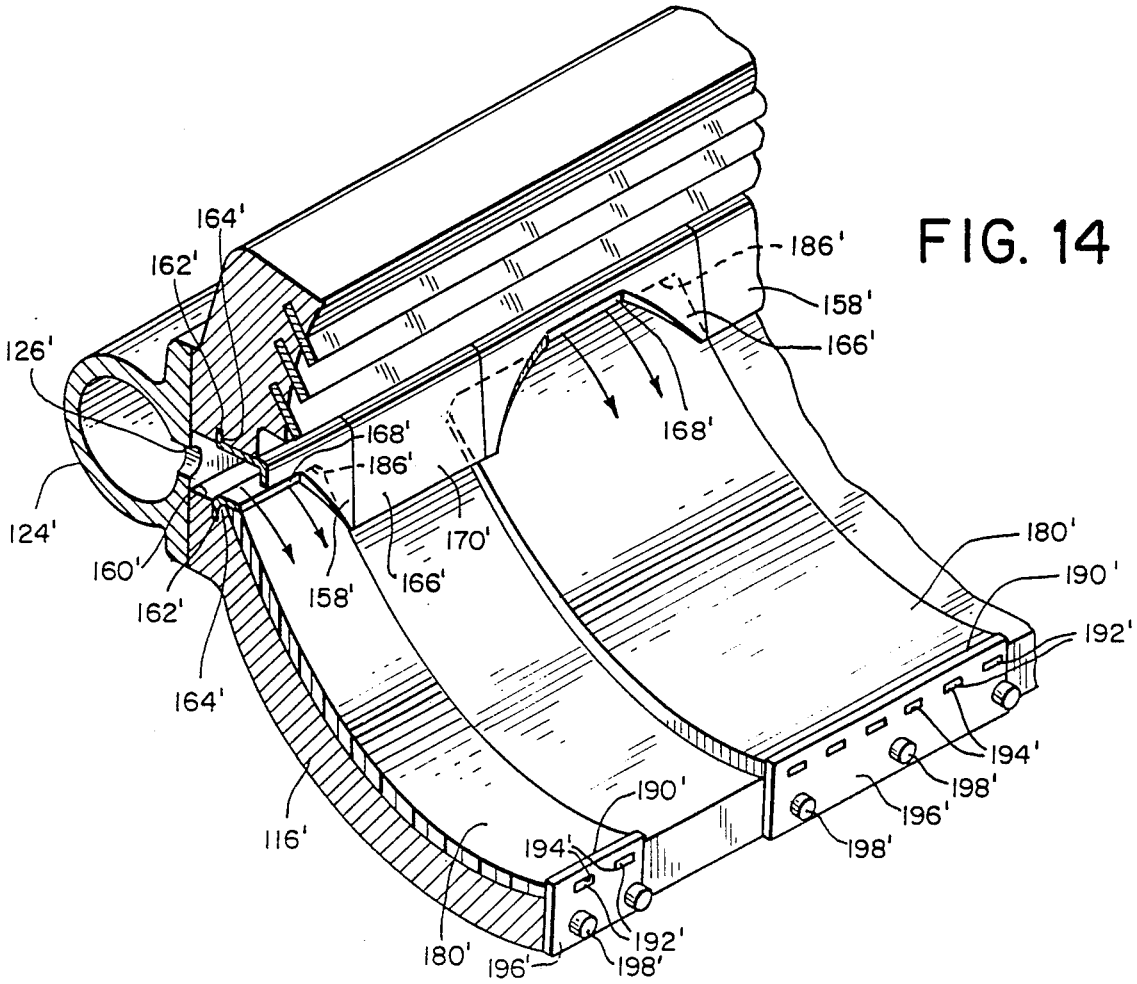

FIG. 14 is a fragmentary perspective view of portions of a variant of the saturator of FIG. 12.

Figure 15:
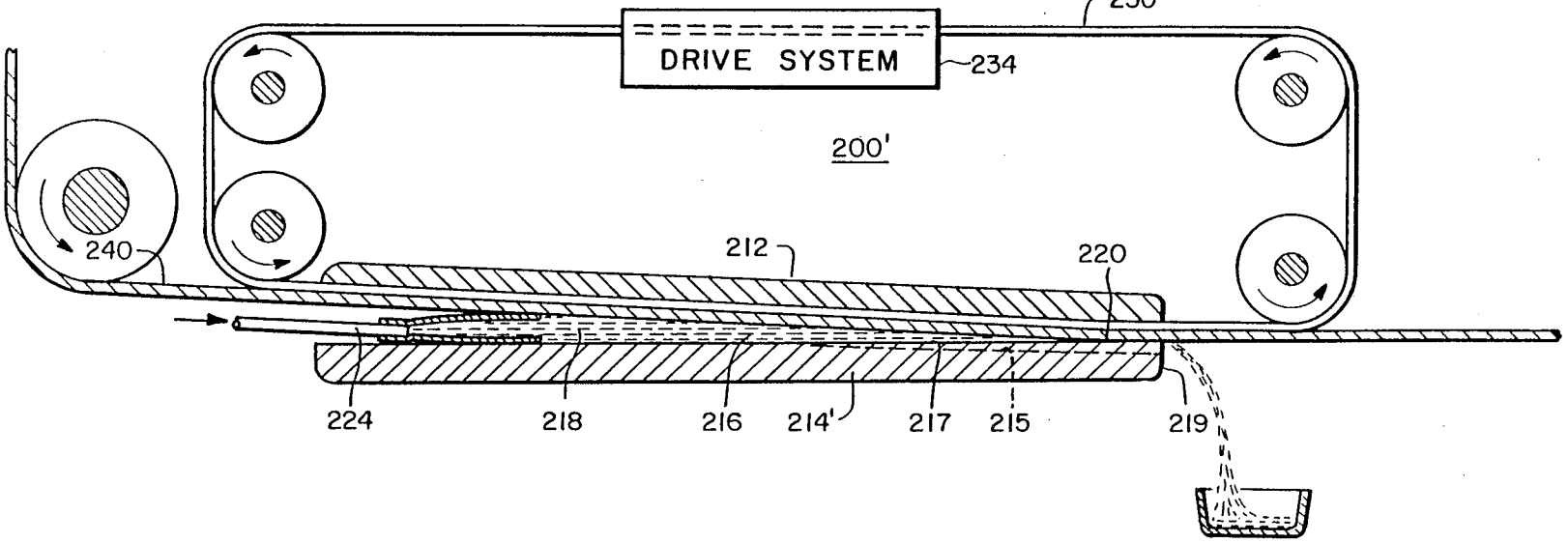

FIG. 15 is a cross-sectional view of an eighth pattern-forming saturator which is similar in some respects to the saturator of FIG. 8.

Figure 16:
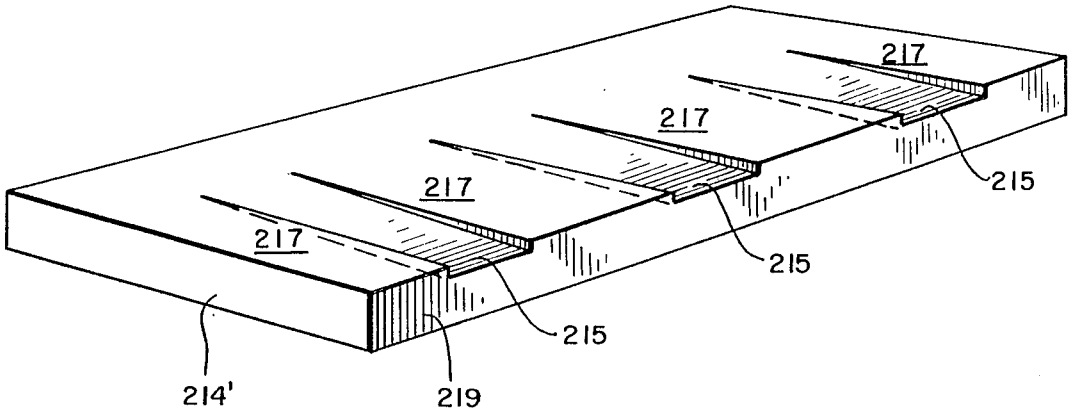

FIG. 16 is a perspective view of a component of the saturator of FIG. 15.

DETAILED DESCRIPTION OF THE PRESENTLY PREFERRED EMBODIMENTS

Turning now to the drawings, FIGS. 1–9 show various views of four pattern-forming saturators which all utilize stencils to prevent the saturant from contacting selected portions of the web. FIGS. 10–16 show various views of four pattern-forming saturators which provide selective saturation of the web without the use of a stencil. The following discussion will take up first the saturators of FIGS. 1–9 and will then turn to the saturators of FIGS. 10–16.

Pattern-Forming Saturators With Stencils

FIG. 1 shows a cross sectional view of a pattern-forming saturator 10 which includes a stencil 50. This saturator 10 includes a mandrel 12 which is mounted for powered rotation about an axis defined by a shaft 14. Typically, the mandrel 12 is formed of a steel shell having a length at least as great as the widest web to be processed. The mandrel 12 is mounted for rotation adjacent to a chamber defining element 16 which extends along the length of the mandrel 12. This chamber defining element 16 defines a chamber 18 between the element 16 and the mandrel 12. This chamber 18 is characterized by an entrance region 20 and an exit region 22. The chamber 18 is deeper in the entrance region 20 than in the exit region 22, and preferably the chamber 18 tapers in depth in a gradual and progressive manner.

A supply port 24 supplies a liquid saturant, such as an aqueous sodium silicate solution, to the chamber 18. If desired, the saturant can be supplied to the chamber 18 under pressure via the supply port 24, or alternately, the self-pressurizing features of the saturator 10 described below can be used to create the desired pressure of saturant within the chamber 18. A plurality of spring seals 26 formed of a suitable spring steel are mounted to the chamber defining element 16 adjacent to the entrance region 20 to impede the flow of saturant out of the chamber 18. An entrance roll 30 and an exit roll 32 are mounted for rotation adjacent to respective sides of the chamber defining element 16.

The features of the saturator 10 described above are substantially identical to those described in Menser U.S. Pat. No. 4,588,616. This patent is hereby incorporated by reference to its detailed teaching of the structure of the saturator 10, and in particular for its teaching of the geometry of the converging chamber 18. As explained in detail in the Menser patent, a web 40 is passed between the mandrel 12 and the chamber defining element 16, such that the web 40 is moved through the chamber 18 from the entrance region 20 to the exit region 22, carried by the rotation of the mandrel 12. Movement of the web 40 through the converging chamber 18 pressurizes the saturant within the chamber 18, thereby forcing the saturant to impregnate voids or pores in the web 40. After the web 40 has been impregnated with the saturant, it leaves the converging chamber 18 via the exit roll 32 and typically passes to an oven (not shown) where volatile components of the saturant are removed. As one example of a suitable saturant, aqueous solutions of sodium silicate as described in the Menser patent can be used. The linear convergence of the converging chamber described in the Menser patent has been found to provide surprisingly good physical properties for the saturated web, and is therefore the preferred configuration for the chamber 18. Of course, other converging geometries can be used as well.

A stencil 50 is provided to prevent patterned portions of the web 40 from coming into contact with the saturant in the chamber 18. This stencil 50 includes both impermeable regions 52 and permeable regions 54. As shown in FIG. 1, the stencil 50 preferably moves in a closed loop about the entrance roll 30, the exit roll 32, and idler rolls 56, such that the stencil 50 is in intimate contact with the side of the web 40 facing the chamber defining element 16. In the permeable regions 54 of the stencil 50, the saturant comes into contact with the web 40 and the web 40 is impregnated with saturant in the conventional manner In the impermeable regions 52 of the stencil 50, the saturant is prevented from coming into contact with the web 40.

The stencil 50 preferably moves at the same linear speed as the web 40, such that there is no relative movement between the web 40 and the stencil 50. In this embodiment, this desired result is obtained in that the web 40 frictionally engages and drives the stencil 50. Of course, in alternate embodiments it may be preferable to provide an active drive system for the stencil 50 to synchronize the linear speed of the stencil 50 with the web 40.

Figure 2A:
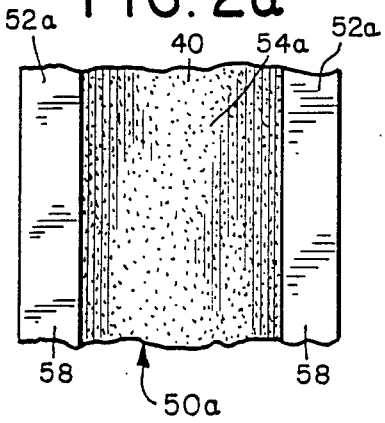
Figure 2B:
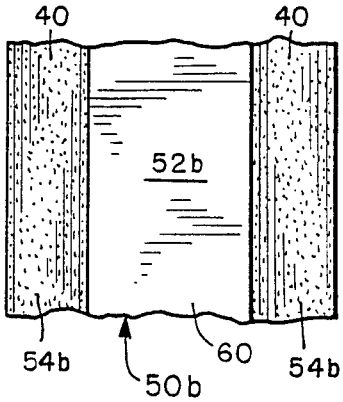
Figure 2C:
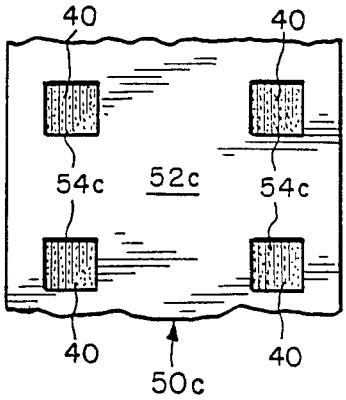

FIGS. 2*a*, 2*b* and 2*c* provide partial plan views of three exemplary stencils 50*a*, 50*b* and 50*c* that may be used with the pattern-formed saturator 10 of FIG. 1. The first example of FIG. 2*a* includes two lateral bands 58, each having a substantially constant width, and each positioned to protect a respective lateral portion of the web 40. Thus, the impermeable regions 52*a* of the stencil 50*a* cover the two lateral edges of the web 40, and the permeable region 54*a* allows the central region of the web 40 to be impregnated with the saturant.

FIG. 2*b* shows an alternative stencil 50*b* which includes one central band 60 having a generally uniform width. This central band 60 is positioned to insure that the impermeable region 52*b* is centered on the web 40 to prevent the central portion of the web 40 from being impregnated with the saturant. The lateral edges of the web 40 are aligned with the permeable regions 54*b* of the stencil 50*b*, and are impregnated with saturant as the web 40 moves through the chamber 18.

FIG. 2*c* shows a third stencil 50*c* which comprises a band that extends over the full width of the web 40. This band defines discreet permeable regions 54*c*, each completely surrounded by the band which forms the impermeable region 52*c*. The stencil 50*c* insures that the saturator 10 impregnates the web with the saturant only in isolated regions aligned with the discrete permeable regions 54*c*.

The saturator 10 provides high saturant pressures in the exit region 22. In order to reduce the leakage of saturant out the exit region 22, the saturator 10 includes an exit seal 70 which is best shown in FIG. 3. In FIG. 3 the stencil 50*a* of FIG. 2*a* is shown for illustrative purposes, including the two lateral bands 58. The exit seal 70 defines recesses 72 positioned to receive the lateral bands 58. These recesses 72 are separated by a raised area 74. The depth of each of the recesses 72 is substantially equal to the thickness of the lateral bands 58. The notched profile of the exit seal 70 defined by the recesses 72 and the raised area 74 seals the exit region 22 to minimize leakage of saturant past the exit seal 70.

In use, the web 40 is passed through the chamber 18 between the stencil 50 and the mandrel 12 such that regions of the web 40 aligned with the impermeable regions 52 of the stencil 50 are protected from contact with the saturant in the chamber 18, while regions of the web 40 aligned with the permeable regions 54 of the stencil 50 are impregnated with the saturant in the conventional manner. In this way, the saturant is applied only to the desired portions of the web 40, thereby providing important advantages in terms of both utility and economy. Utility is improved in that the saturant can be kept out of contact with undesired regions of the web, as for example regions of the web that are to be printed or otherwise processed in a manner incompatible with the saturant. Economy is improved in that by applying the saturant only to the desired portions of the web 40, the usage and therefore cost of the saturant needed to process a particular web 40 are reduced.

FIGS. 4–6 relate to a second saturator 100. This saturator is similar to the first saturator 10 in that it includes a rotatable mandrel 112 and a stationary chamber defining element 116. A converging chamber 118 similar to the chamber 18 of the first preferred embodiment is defined between the element 116 and the mandrel 112. This converging chamber 118 defines a relatively deep entrance region 120 and a relatively shallow exit region 122, as described above. Saturant is supplied to the converging chamber 118 through a manifold 124. In alternate embodiments, the saturant can be supplied via the manifold 124 under a wide range of pressures, depending upon the desired degree of saturation and other parameters of the saturation process.

The chamber defining element 116 is mounted on a frame 134 which is, in turn, pivotably mounted for rotation about a pivot axis 136. This mounting arrangement for the element 116 provides a number of important advantages. First, the frame 134 can readily be pivoted away from the mandrel 112. This simplifies cleaning operations and it allows the element 116 to be moved briefly away from the mandrel 112 when necessary to pass a splice on the web 140. Furthermore, this arrangement allows the depth of the converging chamber 118 at the entrance and exit regions 120, 122 to be adjusted substantially independently of one another. By moving the pivot axis 136 toward and away from the mandrel 112, the depth of the entrance region 120 can be precisely adjusted without substantially altering the depth of the chamber 118 at the exit region 122. Similarly, by providing a precisely adjustable stop surface near the exit region 122, the frame 134 can be positioned so as to obtain the desired depth at the exit region 122 without significantly altering the depth at the entrance region 120.

In the saturator 100, the web 140 is moved through the converging chamber 118 by rotation of the mandrel 112. A stencil 150 is brought into contact with the surface of the web 140 adjacent to the saturant in the converging chamber 118, and friction between the stencil 150 and the web 140 insures that the stencil 150 moves at the same linear speed as the web 140, without slippage between the stencil 150 and the web 140. If desired, an auxiliary drive system can be provided for the stencil 150 to reduce drag on the web 140.

The stencil 150 includes a number of parallel bands spaced across the length of the mandrel 112. The bands themselves form impermeable regions 152 which prevent saturant from reaching the web 140. The regions between the bands act as permeable regions 154 which allow the saturant to reach and impregnate the web 140. FIG. 4 shows a stencil cleaning system 156 which removes saturant from the stencil 150. A variety of approaches can be used in the system 156 to clean the stencil, such as chemical baths, mechanical brushes, scrapers, and the like.

As best shown in FIGS. 5 and 6, an insert 180 is mounted to the element 116 such that it is the insert 180 that defines the interior wall of the converging chamber 118. This insert 180 is provided with a plurality of spaced parallel grooves 182, each sized to receive a respective one of the bands of the stencil 150. The grooves 182 are separated by raised areas 184. As shown in FIG. 5, the grooves 182 increase in depth as they approach the trailing edge 190 of the insert 180, and at the trailing edge 190 the grooves have depth equal to the thickness of the bands such that the raised areas 184 closely approach the web 140 with sufficient clearance to allow web irregularities such as wrinkles to pass.

The insert 180 can be formed of any suitable material and it is anticipated that a range of plastics and metals will be found suitable. The converging chamber 118 is shaped much like the converging chamber 18 shown in FIG. 1, and the leading edge 186 of the insert 180 is positioned to abut a retainer 158 mounted to the element 116 near the entrance region 120.

The presently preferred arrangement for mounting the insert 180 in place is best shown in FIGS. 5 and 6. The element 116 defines a channel 160 which extends parallel to the mandrel 112. This channel 160 defines spaced parallel slots 162 which extend along the length of the channel 160, and the channel 160 is connected to the manifold 124 through a plurality of spaced ports 126. The retainer 158 defines flanges 164 sized to fit within the slots 162 to hold the retainer 158 in place on the element 116. The retainer 158 defines a lip 166 which fits over the leading edge 186 of the insert 180 and holds it in place. A plurality of openings 168 are defined by the retainer 158 to allow saturant to flow from the channel 160 to the converging chamber 118 into the regions between the bands of the stencil 150. Thus, the retainer 158 both holds the leading edge 186 of the insert 180 in place and distributes saturant into the chamber 118.

The trailing edge 180 of the insert 180 defines an array of protruding fingers 192 and these fingers 192 are captured in place by respective openings 194 in a plate 196. The plate 196 is in turn removably secured to the element 116, as for example by screws 198.

The insert 180 acts as a seal by receiving the bands of the stencil 150 within the grooves 182. In effect, the insert 180 becomes a portion of one wall of the converging chamber 118, and this wall is contoured to receive the stencil 150. In this way, the raised areas 184 can be positioned as close to the web 140 as desired to obtain the necessary sealing action and to develop the desired pressure within the converging chamber 118. Of course, in alternate embodiments, the grooves 182 can actually be formed in the element 116, thereby eliminating the need for a separate insert. However, the insert 180 provides important advantages, in that it allows the element 116 to be readily adapted to differing stencils, simply by replacing the insert 180. If necessary, the retainer 158 can readily be removed and replaced as well.

Figure 7A:
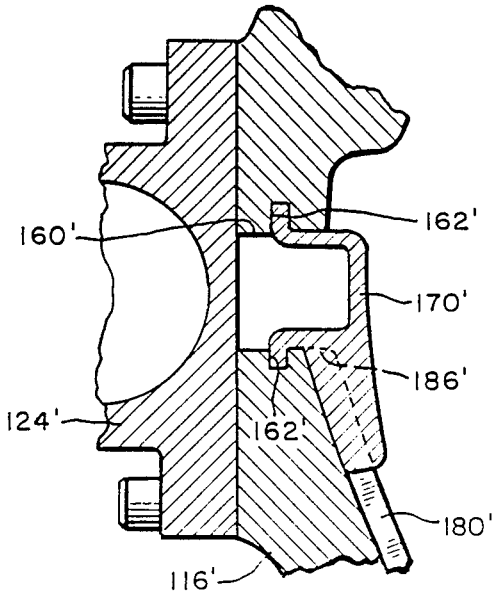
Figure 7B:
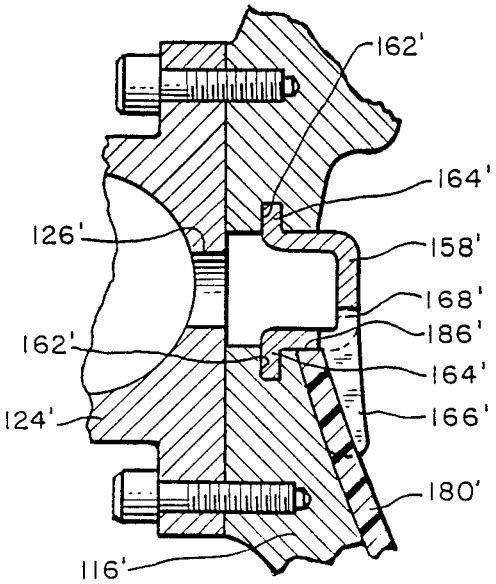

FIGS. 7, 7*a* and 7*b* relate to a third saturator which is similar to the saturator of FIGS. 4–6. The key difference is that in the saturator of FIGS. 7–7*b* the insert, retainer and plate are all formed of separate, modular components. In FIGS. 7–7*b* the same reference numerals are used as in FIGS. 4–6 for corresponding elements, except that the reference numerals of FIGS. 7–7*b* are primed. Except as indicated below, the second and third saturators are identical.

In the saturator of FIGS. 7–7*b*, the insert 180′ is composed of multiple parallel, spaced elements, each of which defines a respective leading and trailing edge 186′, 190′. The leading edges 186′ are held in place by retainers 158′, and the trailing edges 190′ are held in place by plates 196′, all as described above in connection with FIGS. 5–6. The bands of the stencil (not shown) are sized and positioned to move between the inserts 180′. Thus, the inserts 180′ of FIG. 7 correspond in function to the raised areas 184 of FIG. 5 and the regions between the inserts 180′ of FIG. 7 correspond to the grooves 182 of FIG. 5. The retainers 158′ are separated by spacers 170′ which slide in the slots 162′ and block the flow of saturant out of the channel 160′ in the region between the retainers 158′.

The saturator of FIGS. 7–7*b* is modular in construction, and it allows a small number of inserts 180′, retainers 158′, spacers 170′ and plates 196′ to be combined as desired to accommodate a large variety of spacings and widths of the bands of the stencil. Preferably the inserts 180′ are equal in width to the corresponding retainers 158′ and plates 196′.

FIGS. 8 and 9 relate to a fourth saturator 200 which differs significantly from the first, second, and third saturators in that neither of the two chamber defining elements 212,214 moves relative to the other in operation. Rather, each of the elements 212,214 is rigidly held in position by a frame (not shown). The two elements 212,214 define a converging chamber 216 therebetween. This converging chamber 216 includes a relatively deep entrance region 218 and a relatively shallow exit region 220. The elements 212,214 define as extended exit region 222 which provides an important sealing function as described below. Saturant is supplied to the converging chamber 216 via a supply port 224.

This fourth saturator 200 includes upper and lower belts 230,232, each of which is rotated by a respective drive system 234,236 such that the two belts 232,234 move between the elements 212,214 at the same speed, thereby carrying the web 240 through the converging chamber 216. Preferably, these belts 230,232 are formed of an impermeable material such as stainless steel, and suitable lubricants are provided between the belts 230,232 and the chamber defining elements 212,214.

In addition, a closed loop stencil 250 is also passed through the converging chamber 216, positioned immediately adjacent to the web 240. This stencil 250 is moved at the same linear speed as the web 240, carried along by friction between the stencil 250 and the web 240. A stencil cleaning system 256 as described above is provided to remove saturant from the stencil 250.

As best shown in FIG. 9, the stencil 250 comprises a plurality of impermeable regions 252, each made up of a respective one of three parallel bands, and a plurality of permeable regions 254 positioned between the bands. In addition, the bands are interconnected by semi-permeable regions 253. In this embodiment, the semi-permeable regions 253 are formed of an impermeable sheet which defines a plurality of small openings. These openings allow some saturant to flow into the web 240. However, the flow of saturant into those portions of the web 240 aligned with the semi-permeable regions 253 is reduced as compared with the flow of saturant into those portions of the web 240 aligned with the permeable regions 254. Thus, the resulting saturated web 240 is devoid of saturant in certain portions aligned with the impermeable regions 252, is saturated to a greater extent in portions aligned with the permeable regions 254, and is saturated to a lesser extent in portions aligned with the semi-permeable regions 253. This can be of great advantage, for example, in conjunction with containers which are to have a high degree of saturation in the sidewalls, a low degree of saturation in the bend lines between adjacent sidewalls, and substantially no saturation in the end panels. The stencil 250 of FIG. 7 is suitable for such an application. The precise size and spacing of the openings of the semi-permeable regions 253 can be varied widely. However, in many cases it is preferable to have the openings sufficiently closely spaced such that the saturant is distributed across the entire portion of the web 240 aligned with th semi-permeable regions 253, rather than being localized into individual spots.

The extended exits 222 shown in FIG. 6 defines a chamber depth which is substantially equal to the sum of the thicknesses of the belts 230,232, the web 240, and the stencil 250. The length of the extended exit 222 along the direction of motion of the web 240 is preferably greater than the separation between two adjacent semi-permeable regions 253 along the direction of motion of the stencil 250. In this way, the pressure drop across a single one of the semi-permeable regions 253 is reduced, and the tendency to stretch the stencil 250 is reduced as well.

Of course, it should be understood that a wide range of changes and modifications can be made to the saturators described above. For example, it is not necessary in all embodiments that a converging chamber be used. Rather, a non-converging chamber of the type shown in Penley U.S. Pat. No. 2,711,032 is well suited for some applications. Furthermore, the particular geometry of the stencil can readily be adapted for the particular application. In the saturator described above, the stencil is formed of a sheet of stainless steel. However, other materials can be used as appropriate for the particular application. Pattern-Forming Saturators Without Stencils Each of the saturators of FIGS. 1–9 utilizes a stencil to prevent the saturant from contacting selected portions of the web being saturated. In contrast, the saturators of FIGS. 10–16 provide increased saturation of desired portions of the web without the use of a stencil. FIGS. 10–16 show various views of four separate saturators, each of which is similar in important respects to one of the four saturators described above.

Turning now to FIGS. 10 and 11, these figures show two views of saturator 10' which is similar to the saturator 10 of FIG. 1. The mandrel 12 and entrance and exit rolls 30, 32 of FIG. 10 are identical to those described above in conjunction with FIG. 1. However, the chamber defining element 16' of FIG. 10, which is shown in perspective view in FIG. 11, differs in that it defines two spaced parallel grooves 17, one located at each side of the chamber defining element 16'. A raised surface 19 is disposed between the grooves 17. The chamber 18 converges in the region of the raised surface 19, thereby pressurizing the saturant in the region aligned with the raised surface 19 as described above. However, the chamber 18 does not converge towards the exit region 22 in the portion of the chamber 18 aligned with the grooves 17. For this reason, each of the grooves 17 defines a reduced pressure zone in which the saturant is pressurized to a lesser extent than in the high pressure zone aligned with the raised surface 19. In general, it is important that the chamber converge to a lesser extent in the region of the grooves 17 than in the region of the raised surface 19 in order to reduce the saturant pressure in the region of the grooves 17 as compared with saturant pressure in the region of the raised surface 19. In some embodiments it may actually be preferred to cause the grooves 17 to deepen progressively such that the chamber diverges in the region of the grooves 17 in the direction of the exit region.

The saturator of FIGS. 10 and 11 provides selective saturation in a remarkably simple and effective manner. The portion of the web aligned with the raised surface 19 is impregnated in precisely the manner described above in conjunction with FIG. 1. That is, movement of the web through the chamber creates a self-pressurizing action which pressurizes the saturant in the region of the raised surface 19, thereby forcing the saturant into the web 40. However, the portions of the chamber aligned with the grooves 17 do not converge in the direction of the exit region and therefore do not pressurize the saturant. The grooves 17 are open so as to allow saturant to flow freely out of the grooves at the exit region. This reduced saturant pressure significantly reduces or even eliminates the amount of saturant which is forced into the porous web.

By properly adjusting the depth of the grooves 17, the degree of saturation of the part of the web aligned with the grooves 17 can be adjusted as compared with the degree of saturation of the part of the web aligned with the raised surface 19. Even though the entire web is exposed to the saturant in the chamber, the degree of impregnation varies in accordance with the pressurization of the saturant, and in this way selective, patterned saturation is provided by the saturator of FIGS. 10 and 11. For example, the chamber may converge in both the regions aligned with the raised surface 19 and the grooves 17, but the grooves 17 may be shaped such that the degree of saturation of the web aligned with the grooves 17 is only 1% or 10% or 50% of that of the web aligned with the raised surface 19. In general, it is preferable to maintain the depth of the chamber over the raised surface 19 at a low value to provide a relatively sharp line of division between the saturation levels in parts of the web aligned with the raised surface 19 and the grooves 17.

The saturator of FIGS. 12 and 13 does not include a stencil, but is otherwise quite similar to the saturator of FIGS. 4 and 5. The same reference numerals have been used in FIGS. 12 and 13 as in FIGS. 4 and 5 for comparable elements, and the description of these comparable elements will not be repeated here.

In operation, the raised surfaces 184 of the insert 180 create correspondingly positioned high pressure zones in which the web 140 is impregnated with the saturant as described above. The grooves 182 of the insert 180 form low pressure zones, in which the chamber does not converge as sharply toward the exit region as in the high pressure zone, and in which the saturant is pressurized to a lesser extent. As explained above, this reduced pressurization of the saturant reduces impregnation of the saturant into corresponding portions of the web. Thus, the portions of the web 140 which pass over the grooves 182 are saturated to a much lesser extent than the portions of the web 140 which pass over the raised surfaces 184.

FIG. 13 shows a one-piece insert 180 which defines both the grooves 182 and the raised surfaces 184. FIG. 14 shows a variant which is quite similar to the variant of FIG. 7 described above. In the saturator of FIG. 14 the raised surfaces are defined by separate inserts 180', and the grooves are defined between the inserts 180'. As explained above, this approach provides a simple, modular system which allows the geometry of the grooves and the raised surfaces to be modified simply and efficiently. In operation, the saturator of FIG. 14 provides patterned saturation in the same manner as the saturators of FIG. 10 and 12.

FIG. 15 shows a schematic view of a saturator 200' which is similar to the saturator 200 of FIG. 8. However, the saturator 200' does not include a stencil 250, a lower drive belt 232, or associated rollers, drive systems and cleaning systems. FIG. 16 shows a perspective view of the lower chamber defining element 214'. As shown in FIG. 16, this lower chamber defining element 214' defines a plurality of raised surfaces 217 separated by grooves 215 of gradually increasing depth in the direction of the trailing edge 219.

The saturator of FIG. 15 provides selective saturation as described above. The chamber 216 defined between the upper and lower chamber defining elements 212, 214' converges over the raised surfaces 217 such that movement of the web through the chamber 216 pressurizes the saturant over the raised surfaces 217. The chamber 216 does not converge in the region of the grooves 215 and a low pressure zone is formed over each of the grooves 215. For this reason, the web passing through the saturator is selectively impregnated with a greater amount of saturant in the regions of the web aligned with the raised surfaces 217 and with a lesser amount of saturant in the regions aligned with the grooves 215.

Of course, it should be understood that a wide range in changes and modifications can be made to the saturators described above. For example, in some applications it may be preferable to provide drainage openings in the chamber defining element in the region of the grooves so as further to reduce saturant pressure. In this way, saturant can be prevented from contacting portions of the web if desired. Furthermore, in some applications may be preferable to form the grooves on the mandrel or other chamber defining element situated on the side of the porous web opposite the saturant. As explained above, the precise geometry of the grooves may vary both with respect to the depth profile and the width of the grooves. If desired, the grooves may be shaped such that the chambers converge in both the low pressure zone and the high pressure zone in order to provide lower and higher degrees of saturation of the web, respectively.

It is therefore intended that the foregoing detailed description be regarded as illustrative rather than limiting, and that it can be understood that it is the following claims, including all equivalents, which are intended to define the scope of this invention.

I claim:

1. A saturator for impregnating a porous web with a saturant, said saturator comprising:

means for defining a chamber, said chamber having a pair of opposed walls, an entrance region, an exit region, a length extending between the entrance and exit regions, and a width extending transverse to the length;

means for passing the web through the chamber from the entrance region to the exit region; and means for introducing the saturant into the chamber such that the saturant contacts at least a portion of at least one side of the web as the web passes through the chamber;

said chamber defining at least first and second zones laterally spaced across the width of the chamber;

said first zone converging in depth from the entrance region to the exit region such that movement of saturant in the chamber pressurizes the saturant in the first zone to cause the saturant to impregnate a first strip of the web aligned with the first zone;

said second zone shaped to reduce saturant pressure in the second zone as compared with the first zone such that the first strip of the web aligned with the first zone is impregnated with the saturant to a greater extent than a second strip of the web aligned with the second zone.

2. The invention of claim 1 wherein said second zone is shaped to substantially eliminate saturant impregnation of the second strip of the web.

3. The invention of claim 1 wherein the chamber defining means comprises first and second opposed elements, each of which defines a respective one of the opposed walls, and wherein said first element defines a groove aligned with the second zone.

4. The invention of claim 3 wherein the second element comprises a rotatable mandrel.

5. A saturator for impregnating a porous web with a saturant, said saturator comprising:

means for defining a chamber, said chamber having first and second opposed walls, an entrance region, and an exit region;

means for passing the web through the chamber from the entrance region to the exit region along a transport axis;

said first wall defining at least one raised surface and at least one groove spaced from one another along a wide axis, transverse to the transport axis, said raised surface and groove alignable with first and second laterally spaced portions of the web, respectively;

means for introducing the saturant into the chamber between the web and the first wall such that the saturant contacts the web across the full width of the first portion and at least part of the second portion of the web as the web passes through the chamber;

said raised surface positioned to converge with the second wall in the exit region such that movement of saturant through the chamber pressurizes the saturant over the raised surface, thereby forcing the saturant into the first portion of the web aligned with the raised surface;

said groove positioned with respect to said second wall to reduce saturant pressure over the groove as compared with saturant pressure over the raised surface, such that the first portion of the web is characterized by increased saturant impregnation as compared with the second portion of the web.

6. The invention of claim 5 wherein the saturant introducing means causes the saturant to contact the web across the full width of the web.

7. The invention of claim 5 wherein said groove is configured to substantially eliminate saturant impregnation of the second portion of the web.

8. The invention of claim 5 wherein the first wall is defined by a stationary member, and wherein the second wall is defined by a mandrel mounted for rotation with respect to the stationary member.

9. The invention of claim 5 wherein at least the raised surface is defined by an insert which is removably mounted on a chamber defining member included in the chamber defining means.

10. The invention of claim 9 wherein the insert further defines the groove.

11. The invention of claim 9 wherein the saturant introducing means comprises a saturant supply channel extending across the chamber defining member, and wherein the invention comprises at least one retainer mounted on the chamber defining member over the channel, said retainer comprising means for controlling saturant flow out of the channel and means for securing one edge of the insert to the chamber defining member.

12. The invention of claim 11 wherein the securing means of the retainer comprises a lip positioned over the edge of the insert.

13. The invention of claim 9 wherein the insert defines an array of projections extending away from one edge thereof, and wherein the invention further comprises a plate removably mounted to the chamber defining member, said plate defining a plurality of openings sized to receive respective ones of the projections to secure the insert in place.

14. The invention of claim 5 wherein said at least one raised surface comprises a pair of raised surfaces, and wherein the invention further comprises:

at least a pair of inserts; and means for removably mounting the inserts to a chamber defining element included in the chamber defining means such that the inserts form the raised surfaces and define the groove therebetween.

15. The invention of claim 14 wherein the chamber defining means defines a saturant supply channel, and wherein the mounting means comprises at least one pair of retainers mounted to the chamber defining means over the channel, said retainers each comprising means for directing saturant flow out of the channel and over a leading edge of the respective insert and a lip positioned over the leading edge of the respective insert.

16. The invention of claim 15 wherein each of the retainers is substantially equal in width to the respective insert.

17. The invention of claim 14 wherein each of the inserts defines an array of projections extending away from a trailing edge thereof, and wherein the mounting means comprises at least a pair of plates removably mounted to the chamber defining means, said plates each defining a plurality of openings sized to receive respective ones of the projections to secure the respective insert in place.

18. The invention of claim 17 wherein each of the plates is substantially equal in width to the respective insert.

19. The invention of claim 5 wherein each of the grooves and each of the raised surfaces defines a respective constant width.

20. In a saturator of the type comprising means for defining a chamber which converges from an entrance region to an exit region, means for supplying a saturant to the chamber, and means for passing a porous web through the chamber along a direction of travel from the entrance region to the exit region, wherein the chamber is shaped such that movement of the saturant through the chamber pressurizes the saturant in a pressurized zone which includes the exit region, thereby impregnating the web with the saturant, the improvement comprising:

means, included in the chamber defining means, for forming at least one reduced pressure zone in the exit region adjacent to and laterally spaced from the pressurized zone with respect to the direction of travel of the web, said reduced pressurized zone characterized by a reduced saturant pressure as compared with the pressurized zone such that portions of the web aligned with the pressurized zone are impregnated with saturant to a greater degree than portions of the web aligned with the reduced pressure zone.

21. The invention of claim 20 wherein the chamber defining means comprises at least one wall and wherein the reduced pressure zone forming means comprises at least one groove formed in the wall.

22. The invention of claim 21 wherein the at least one groove is aligned with the direction of travel of the web.

23. The invention of claim 20 wherein the chamber defining means comprises a stationary member and a rotatable mandrel which define the chamber therebetween.

24. The invention of claim 20 wherein the low pressure zone is configured such that substantially no saturant is impregnated into portions of the web aligned with the low pressure zone.

25. A method for selectively impregnating a porous web with a saturant comprising the following steps:

(a) providing a chamber which includes an entrance region and an exit region, said chamber converging from the entrance region to the exit region in a first, relatively high pressure zone, said chamber also defining a second, relatively low pressure zone situated alongside the high pressure zone;

(b) introducing the saturant into the chamber; and (c) passing the web through the chamber from the entrance region to the exit region such that the saturant is brought into contact with the web in both the high pressure zone and the low pressure zone;

said chamber shaped such that movement of the saturant through the chamber generates higher pressures in the high pressure zone than the low pressure zone, thereby impregnating portions of the web aligned with the high pressure zone with a greater amount of the saturant than portions of the web aligned with the low pressure zone.

26. The method of claim 25 wherein the chamber is defined between a mandrel and a stationary member, and wherein the passing step comprises the step of rotating the mandrel to carry the web through the chamber.

27. The method of claim 25 wherein the chamber converges in the high pressure zone to a greater extent than in the low pressure zone.

* * * * *

UNITED STATES PATENT AND TRADEMARK OFFICE

CERTIFICATE OF CORRECTION

PATENT NO. : 4,740,391

DATED : April 26, 1988

INVENTOR(S) : ELIOT R. LONG

It is certified that error appears in the above-identified patent and that said Letters Patent is hereby corrected as shown below:

IN THE BACKGROUND OF THE INVENTION

In column 2, line 9, please delete "interslices" and substitute therefor --interstices--.

IN THE SUMMARY OF THE INVENTION

In column 2, line 15, please delete "formed" and substitute therefor --forming--.

In column 2, line 40, please delete "pressurized" and substitute therefor --pressure--.

IN THE DETAILED DESCRIPTION OF THE PRESENTLY PREFERRED EMBODIMENTS

In column 4, line 37, please delete "to" and substitute therefor --for--.

In column 5, line 3, after "manner" please insert --. --.

In column 5, line 17, please delete "formed" and substitute therefor --forming--.

In column 7, line 2, after "have" please insert --a--.

In column 8, line 24, please delete "as" and substitute therefor --an--.

In column 9, line 5, please delete "th" and substitute therefor --the--.

UNITED STATES PATENT AND TRADEMARK OFFICE

CERTIFICATE OF CORRECTION

PATENT NO. : 4,740,391

DATED : April 26, 1988

INVENTOR(S) : ELIOT R. LONG

It is certified that error appears in the above-identified patent and that said Letters Patent is hereby corrected as shown below:

In column 9, lines 29 and 30, please delete "Pattern-Forming Saturators Without Stencils" and substitute therefor, between lines 29 and 31, a heading --Pattern-Forming Saturators Without Stencils--.

In column 9, line 40, after "of" please insert --a--.

In column 11, line 43, please delete "can".

IN THE CLAIMS

In column 12, line 25, please delete "wide" and substitute therefor --width--.

Signed and Sealed this

Sixth Day of February, 1990

*Attest:*

JEFFREY M. SAMUELS

*Attesting Officer*

*Acting Commissioner of Patents and Trademarks*